United States Patent [19]

Kitagawa

[11] Patent Number: 4,612,788

[45] Date of Patent: Sep. 23, 1986

[54] METHOD FOR CONTROLLING SHAPE OF MATERIAL IN ROLLING PROCESS

[75] Inventor: Soichi Kitagawa, Kobe, Japan

[73] Assignee: Kabushiki Kaisha Kobe Seiko Sho, Kobe, Japan

[21] Appl. No.: 798,398

[22] Filed: Nov. 15, 1985

[51] Int. Cl.[4] ..... B21B 37/10; B21B 37/04; B21B 27/06

[52] U.S. Cl. ..... 72/13; 72/17; 72/201

[58] Field of Search ..... 72/13, 200, 201, 17

[56] References Cited

U.S. PATENT DOCUMENTS 3,616,669 11/1971 Shumaker ..... 72/200
3,802,237 4/1974 Albensi et al. ..... 72/200
4,262,511 4/1981 Boisuert et al. ..... 72/201
4,467,629 8/1984 Schimion ..... 72/201

*Primary Examiner*—Francis S. Husar
*Assistant Examiner*—Jorji M. Griffin
*Attorney, Agent, or Firm*—Oblon, Fisher, Spivak, McClelland & Maier

[57] ABSTRACT

A method for controlling the shape of a cold-rolled material which is capable of switching the roll coolant from a hot coolant to a cold coolant without changing the cooling capacity. The cold coolant is switched to a hot coolant as soon as the supply of hot coolant reaches a maximum flow rate and the flow rate of the cold coolant is controlled to be a value which gives a cooling capacity equivalent to that of the work roll by the hot coolant.

2 Claims, 6 Drawing Figures

METHOD FOR CONTROLLING SHAPE OF MATERIAL IN ROLLING PROCESS

BACKGROUND OF THE INVENTION

1. Field of the Invention

This invention relates to a method for controlling the shape of material in rolling processes, and more particularly to a method for controlling the shape of a cold-rolled material.

2. Discussion of Background

For the control of the shape of rolled material which is obtained by a cold rolling operation, it has been the conventional practice to employ the thermal crown control in addition to the work roll bending control which control the roll camber by varying the bending load of the work roll.

Shown in FIG. 1 is a typical thermal crown control method, in which a plurality of coolant spout nozzles 2 are provided at intervals in the axial direction of a barrel shaft of a work roll 1 for spurting a roll coolant therefrom, and the shape of the rolled material is detected by a shape detector (not shown) which produces shape parameters P as its output signal. The shape parameters P are led to a coolant supply control unit 20 thereby to calculate a local deviation $\epsilon(j)$ of the shape parameter P at a position j in the axial direction of the barrel shaft from a target shape parameter M, supplying a valve opening control signal proportional to the local deviation $\epsilon(j)$ to a flow control valve 3 for a coolant spout nozzle 2 which is located at the position j in the axial direction of the barrel shaft. Indicated at 4 is a roll coolant circulating tank, at 5 a feed pump, and at 6 is a main piping.

The above-described conventional method, however, has a problem in that the cooling capacity of the roll coolant becomes insufficient even at a maximum flow rate in some cases because the temperature of the roll coolant is at a constant level. Of course, it is possible to provide a roll coolant of a lower temperature (a cold coolant) in addition to the ordinary roll coolant (a hot coolant), and to switch to the cold coolant when the cooling capacity beomes deficient. The cooling capacity can be increased by this method, but there arises another problem that the sudden change of the cooling capacity makes the control of the thermal crown discontinuous. Further, in a case where the rolled strip contains a sheet crown, the accuracy of the shape control is impaired by variations in the contact angle of the rolled strip with the shape detector or sensor roller in the width wise direction of the strip, which cause differences in detected axial load between the center and end portions of the strip.

SUMMARY OF THE INVENTION

Accordingly, one object of the present invention is to provide an improved method for controlling the shape of material in a rolling process, which comprises switching the roll coolant from a hot coolant to a cold coolant or vice versa without changing the cooling capacity in order to maintain continuity of control. This is achieved by switching the roll coolant to a cold coolant as soon as the supply of a hot coolant reaches a maximum flow rate while controlling the flow rate of the cold coolant to a value which gives a cooling capacity equivalent to that of the work roll by the hot coolant.

It is another object of the present invention to provide a method of correcting errors arising from variations in contact angle in the transverse direction of a rolled strip containing a sheet crown, with respect to a shape detector or sensor roller.

In accordance with the present invention, the above-mentioned primary object is achieved by a method of controlling the shape of a rolled strip, in which coolant flow rates of roll coolant spray nozzles located at intervals along the barrel of a work roll are controlled according to output signals of a shape detector adapted to detect the shape of the rolled strip in the width wise direction thereof. The method essentially involves the steps of: switchably connecting through a change-over valve the roll coolant spray nozzles to a first main feed pipe for supplying a first cooling medium to the spray nozzles and to a second main feed pipe for supplying a second cooling medium to said spray nozzles; providing a temperature detector for measuring the temperature of the work roll surface; and switching the change-over valve to connect the second main feed pipe to the spray nozzles to feed the second cooling medium thereto when the spout rate of the first cooling medium reaches a maximum level, while controlling the feed rate of the second cooling medium to each spray nozzle in proportion to a value calculated by multiplying the maximum feed rate of the first cooling medium by a ratio of the difference between the temperature of the first cooling medium and the temperature detected by the temperature detector to the difference between the temperature of the second cooling medium from the temperature detected by the temperature detector.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF PREFERRED EMBODIMENTS

Figure 1:
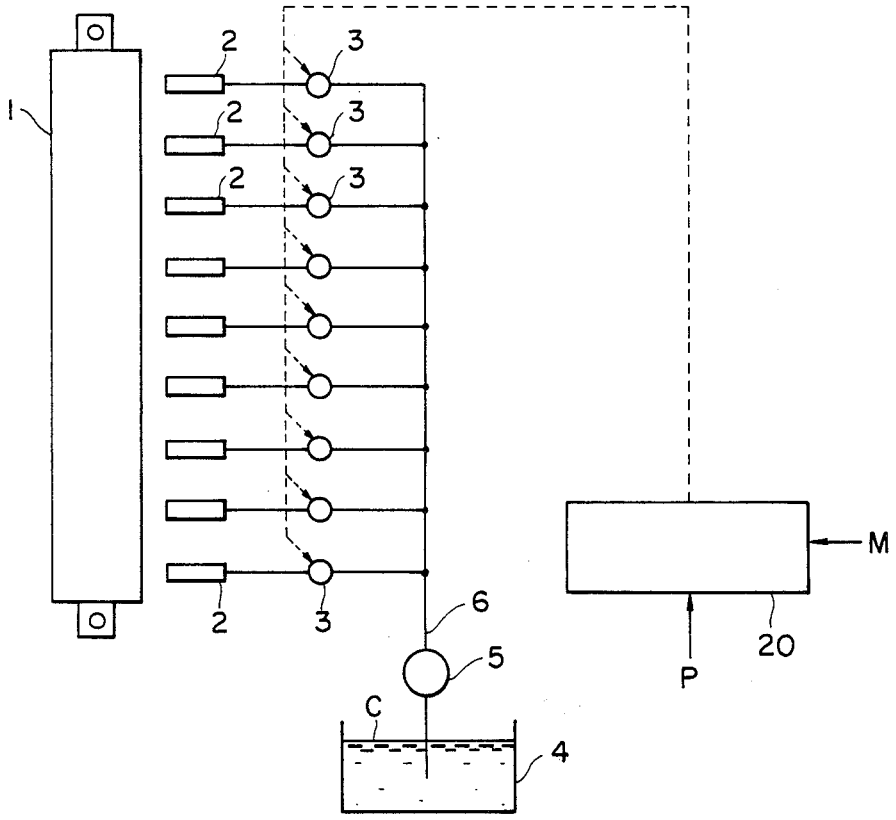
FIGURE 1 PRIOR ART
FIG. 1 is a flowsheet employed for the explanation of a conventional shape control method.
Figure 2:
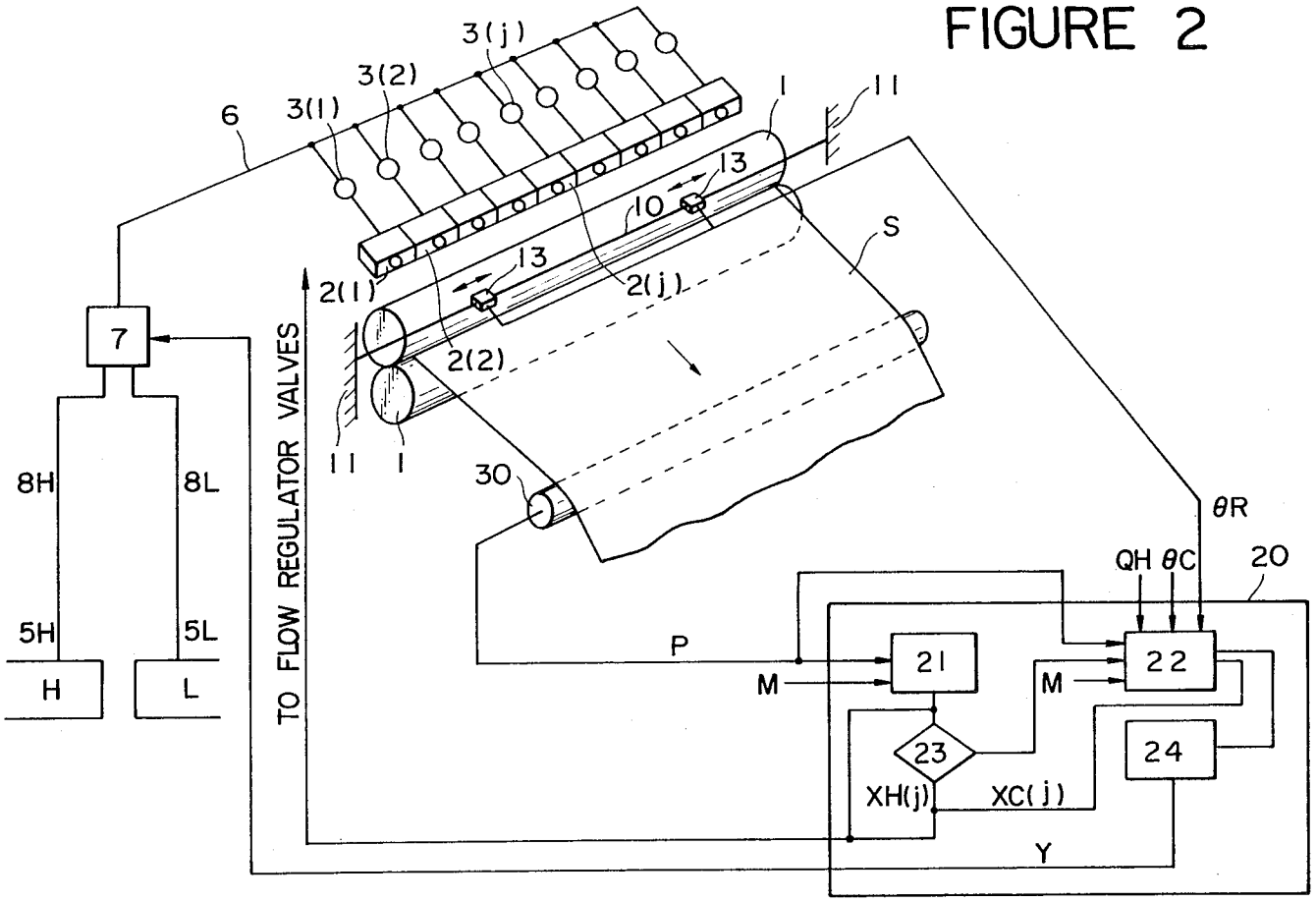
FIG. 2 is a block diagram showing an embodiment of the present invention.
Figure 3:
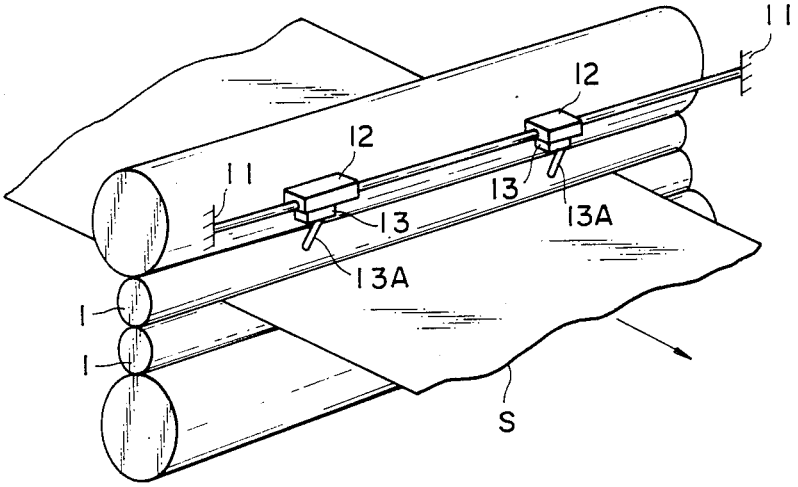
FIG. 3 is a perspective view of a roll surface temperature detector employed in the embodiment of FIG. 2.

Referring now to the drawings, wherein like reference numerals designate identical or corresponding parts throughout the several views, and more particularly to FIGS. 2 and 3 thereof, there is illustrated the main element of the system constituting the invention, the spaced apart coolant spout nozzles 2(1), 2(2) . . . **2(*j*) are connected, through piping 6, to a change-over valve 7 through flow control valves 3(1), 3(2) . . . 3(*j*), respectively. Connected to the change-over valve 7 are a main hot coolant feed pipe 8H** and a main cold coolant feed pipe 8L. Indicated at 9H is a hot coolant circulating tank, and at 9L is a cold coolant circulating tank.

Further, denoted at 10 is a rail which is bridged between roll stands 11 in parallel relation with work rolls 1, and at 12 are head frames which movably mounted on the rail 10 and fixedly supports thereon infrared temperature detectors 13. The head frames 12 are driven from a reciprocal drive means, not shown, in such a manner as to to scan the right- and left-hand sections of the work roll 1 by the infrared temperature detectors for detecting the temperature of the work roll 1 along its entire width in the axial direction of the barrel shaft. The detecting head 13A of each infrared temperature detector 13 is located opposingly to the work roll 1 in a position close to the surface of the latter. The work roll surface temperature detector is constituted by these components 10 to 13. Designated at 30 is a shape detector (e.g., a sensor roll with a row of pressure sensitive members in its axial direction).

The coolant supply controller 20 (an arithmetic and logic processor) includes a cold coolant jet feed rate computing unit 22, a hot coolant jet feed rate computing unit 23 and a switch signal generator 24, in addition to a coolant jet feed rate computing unit 21 which is common to the conventional processors. On the basis of the temperature signals $\theta R$ (electric signals) from the temperature detectors 13 of the work roll surface temperature detector, the shape P (a parameter signal) of the rolled strip S from the shape detector 30, the temperature $\theta H$ of the hot coolant H, and the temperature $\theta C$ of the cold coolant C, the coolant supply controller 20 execute arithmetic operations to determine:

(1) The flow rate Q(j) (open rates) of the respective flow regulator valves 3(j);

(2) Whether or not the flow rate of the hot coolant is at the maximum value QH(j)max; and (3) The flow rate of the cold coolant Qc(j)

$$Qc(j) = \frac{\theta R - \theta H}{\theta R - \theta C} \times QH(j)\max \quad (1)$$

and sends out valve opening control signals X(j) and a coolant switch signal Y.

Figure 4:
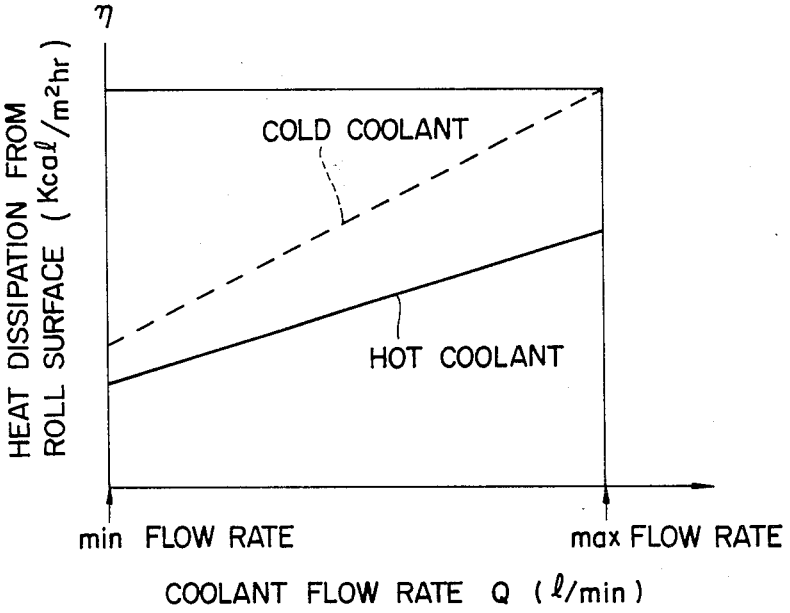
FIG. 4 is a diagram showing the quantity of heat dissipation from the roll surface against the roll coolant flow rate.

Now, reference is had to the diagram of FIG. 4, showing the quantity of heat dissipation from the roll surface in relation with the flow rate of the roll coolant.

Expressing the heat conductivity by K, and the coolant flow rate by Q, the quantity of heat dissipation qo from the surface of the work roll 1 at the maximum flow rate of the hot coolant is expressed as $$qo = A \cdot KQH(j)\max(\theta R - \theta H) \quad (2)$$

where A is the surface area of the work roll 2 and K is a constant. On the other hand, the cold coolant flow rate Qc(j) at which the heat dissipation amounts to the same quantity qo is expressed as $$q\theta = A \cdot KQc(j)(OR - Oc) \quad (3)$$

From Eqs. (2 ) and (3), we obtain afore-mentioned Eq. (1).

With the above arrangement, the coolant spout nozzles 2(j) are normally connected to the hot coolant circulating tank 9H through the change-over valve 7 to receive the hot coolant H through the hot coolant supply pipe 8H, spouting the hot coolant H all over the respective zones of the work roll 1. At this time, the quantity QH of coolant which is spurted out of the respective spout nozzles 2(j) is controlled by computing deviations (j) of the pattern of the shape parameter signals P from the pattern of the preset target shape parameter M by the hot jet computing unit 21 and sending the results of computation as the valve opening control signals X(j) to the corresponding flow regulator valves 3(j) through the above-mentioned output device.

As soon as the total amount of spouted hot coolant H reaches a predetermined value (the maximum value), a spouted volume discriminator 23 detects this and dispatches an operation command to the cold coolant computing unit 22 thereby to compute the flow rate of the cold coolant for the spout nozzles 2(j) according to Eq. (1). The results of the computation are sent to the flow regulator valves 3(j) as the valve opening control signals X(j) through the output device which is not shown. Simultaneously, a coolant switch signal is produced by the valve switch signal generator and sent to the change-over valve 7 through the output device.

Consequently, by the switch from the hot coolant H to the cold coolant C, the quantity Q(j) of the coolant which is spurted from the coolant spout nozzles 2(j) is changed from QH(j) to Qc(j) without varying the quantity of heat dissipation from the work roll 1. Thereafter, the coolant spout rate is calculated by the cold coolant computing unit 22 and produces the valve opening control signals X(j) on the basis of the shape parameter signals P and the target shape parameter M to eliminate the thermal crown of the work roll 2 by the cold coolant, that is to say, to control the shape of the strip S which is being rolled.

Figure 5:
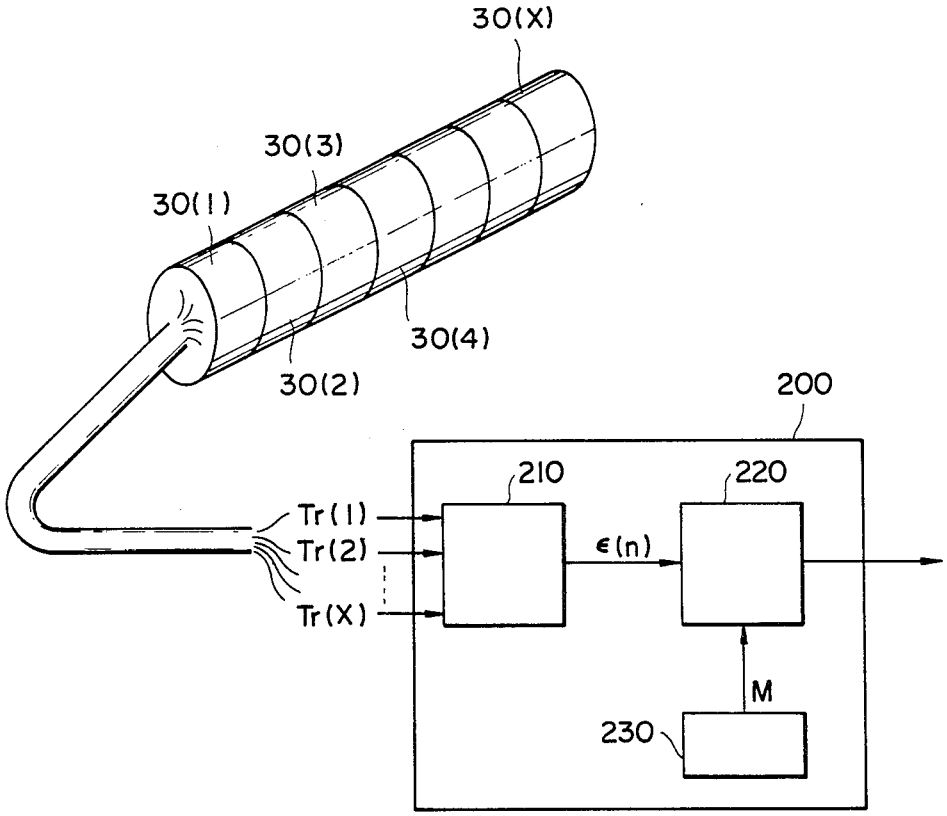
FIG. 5 illustrates a conventional method of processing signals from a shape detector.

With regard to the shape detector, it has been the general practice to employ a sensor roller 30 with a number of piezoelectric or magneto-strictive type pressure sensitive members 30(1), 30(2) . . . 30(x) in a row in the axial direction as shown in FIG. 5, supplying a functionalizer 210 of a shape signal processor 200 with sample shape parameters Tr(x) (electric signals proportional to the axial load of the rolled strip S) which are produced by the respective pressure sensitive members 30(x). The functionalizer 210 approximates the shape of the rolled material by a function of n-order on the basis of the received shape parameters Tr(x), producing a functional output $\epsilon(n)$ to be sent to a comparator 220. The comparator 220 compares the function $\epsilon(n)$ with the target shape parameter M and sends the resulting deviation as a shape control signal to the roll coolant supply controller, which is not shown, to compute the coolant spout rates through the respective roll coolant spout nozzles and send corresponding valve opening control signals to the flow control valves which are provided in the inlet pipings of the coolant spout nozzles.

As mentioned hereinbefore, however, in a case where the rolled strip S contains a sheet crown, the strip coil on a take-up reel takes the form of a barrel, giving rise to a problem that the contact angle of the strip S relative to the shape detector or sensor roller varies in the widthwise direction of the strip S, more particularly, between the center and end portions of the strip S, as a result the detected axial loads differ between the center and end portions even if the strip is uniformly tensioned across its entire width, lowering the accuracy of the shape detection and making it difficult to provide reliable shape control.

Figure 6:
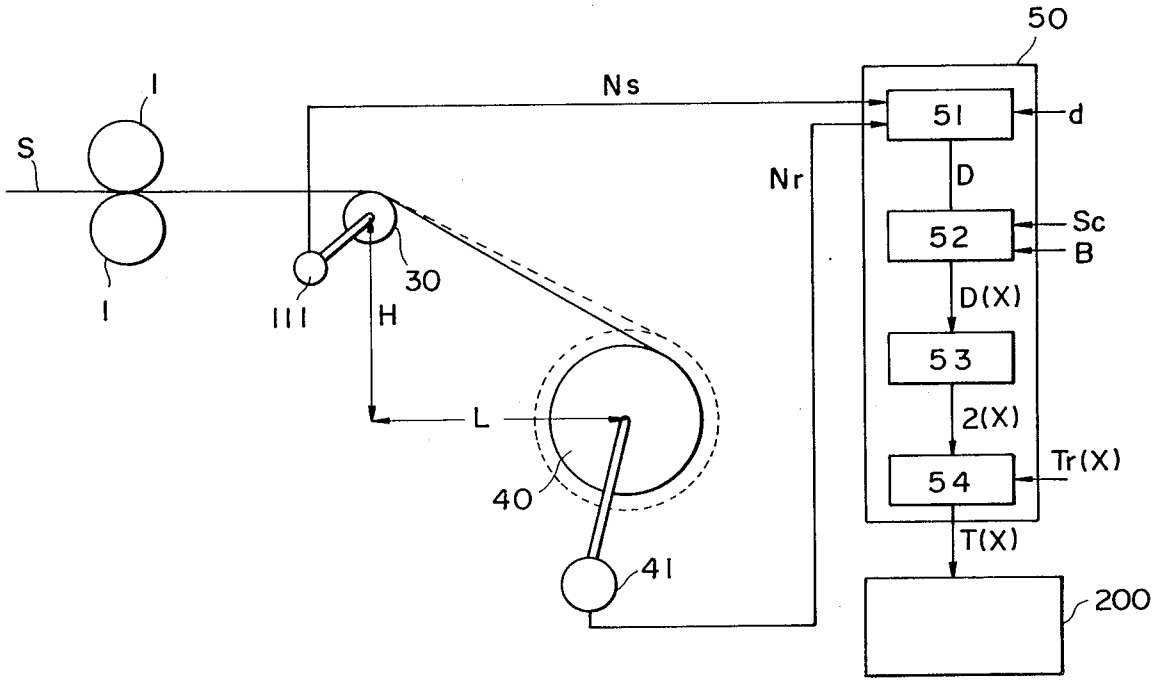
FIG. 6 illustrates the steps of the method of the invention for correcting errors in output signals of the shape detector arising from a sheet crown of a rolled strip.

Shown in FIG. 6 is another embodiment of the invention employing means for correcting errors accruing from the coil crown, in which indicated at 1 are work rolls, at 40 a take-up roll, at 41 a rotational speed sensor, and at 50 a correction processor which includes an arithmetic unit 51 for calculating the coil diameter, an arithmetic unit 52 for calculating the coil crown, an arithmetic unit for calculating the contact angles of the rolled strip S, and a correcting unit 54. Denoted in 111 is a revolution counter, and at S a rolled strip.

The correction processor 50 calculates the diameter D of the strip coil C on the take-up reel 60 on the basis of the number Nr of revolutions (of the strip coil) from the rotation sensor 41 which detects the number of revolutions of the take-up reel 40 and the number Ns of revolutions from the rotation sensor 11 which detects the number of revolutions of the sensor roller 30, as follows.

$$D=(Ns\times d)\times 1/Nr \quad (4)$$

where d is the diameter of the sensor roller 30.

The arithmetic unit 52 for the coil crown calculates the coil diameter D(x) at a position which is distant from the center of the width of the strip S by a distance x, namely, at a position corresponding to the measuring zone of the pressure sensitive member 3(x), as follows.

$$D(x)=D+2D\times[1+(Sc/100)]\times(1-4x^2/B^2) \quad (5)$$

where B is the strip width and Sc is the sheet crown rate of the strip.

The arithmetic unit 53 calculates the contact angle $\alpha(x)$ of the strip S relative to the sensor roller 30, as follows.

$$\alpha(x) = (\pi/2) - \tan(L/H) - \sin[(D\,d)/2\sqrt{L^2+H^2}\,] \quad (6)$$

where L is the distance between the centers of the take-up reel and sensor roller and H is the difference between the heights of the centers of the take-up reel and sensor roller.

The arithmetic correcting unit 54 is arranged to correct the shape parameters Tr(x) according to the contact angles (x) and to send the corrected shape parameters T(x) to the functionalizer 210 of the shape signal processor 200.

$$T(x)=Tr(x)/[2\sin(\alpha(x)/2)] \quad (7)$$

With regard to the sheet crown rate of the strip S, it is suitable to use the sheet crown rate on the upstream side because a sheet crown is maintained before and after rolling to keep the flatness of the strip S and because there is only a very small difference between the sheet crown rates before and after rolling.

In this particular embodiment, even if the strip coil C on the take-up reel 40 takes the form of a barrel with varying contact angle in its widthwise direction, the contact angles in the respective measuring zones of the pressure sensitive members 30(x) are calculated by arithmetic operations to correct the outputs of the pressure sensitive members 30(x). Accordingly, the corrected outputs T(x) are load signals which are not significantly influenced by the condition or shape of the reeled coil C, and therefore the functions $\epsilon(x)$ accurately represent the tension distribution of the strip.

Although the coil diameter D is determined by an arithmetic unit in the foregoing embodiment, it may be obtained by actual measurement if desired.

As clear from the foregoing description, the method of the present invention can switch the roll coolant from a hot coolant to a cold coolant without changing the amount of heat dissipation from the work rolls to ensure continuity of the control and at the same time to enlarge the capacity of control to a significant degree as compared with conventional methods. In addition, by calculating the contact angles of the coil in the measuring zones of the respective pressure sensitive members of the sensor roller in relation to the sheet crown rate of the strip and correcting the outputs of the pressure sensitive members according to the contact angles, so that, even in a case where the strip contains a sheet crown, it becomes possible to detect the shape of the strip from the corrected outputs of the pressure sensitive members which give the values proportional to the tensile forces of the strip in the respective measuring zones, to realize an accurate shape control.

Obviously, numerous modifications and variations of the present invention are possible in light of the above teachings. It is therefore to be understood that within the scope of the appended claims, the invention may be practiced otherwise than as specifically described herein.

What is claimed is:

1. A method for controlling the shape of a rolled strip in rolling operation in which coolant flow rates of roll coolant spray nozzles located at intervals along the barrel of a work roll are controlled accordingly to output signals of a shape detector adapted to detect the shape of the rolled strip in the widthwise direction thereof; said method essentially comprising the steps of:

switchably connecting by means of a change-over valve said roll coolant spray nozzle to one of a first main feed pipe for supplying a first cooling medium to the spray nozzles and a second main feed pipe for supplying a second cooling medium to said spray nozzles;

providing a temperature detector for detecting temperatures on the surface of said work roll;

switching said change-over valve to connect said second main feed pipe to said spray nozzles to feed said second cooling medium thereto when the flow rate of the first cooking medium reaches a maximum level and controlling the feed rate of the second cooling medium to each spray nozzle in proportion to a value calculated by multiplying the maximum feed rate of said first cooling medium by a ratio of the difference between the temperature of said first cooling medium and the temperature detected by said temperature detector to the difference between the temperatures of said second cooling medium and temperature detected by said temperature detector.

2. The method of claim 1 wherein said shape detector consists of a sensor roller having a plural number of pressure sensitive members in a row in the axial direction thereof to detect radial load of the rolled strip thereby to measure the distribution of tensile force of said strip being turned to an arbitrary direction in contact with said sensor roller, said method further comprising the steps of:

computing diameters of a reeled coil in the measuring zones of the respective pressure sensitive members on the basis of either the actually measured or the calculated coil diameter on a take-up reel and a preset sheet crown rate of a rolled strip;

computing contact angles of said rolled strip relative to said take-up reel on the basis of the computed diameters; and correcting the outputs of said pressure sensitive members according to the computed contact angles.

* * * * *